US010617962B2

(12) United States Patent
Mayer et al.

(10) Patent No.: US 10,617,962 B2
(45) Date of Patent: Apr. 14, 2020

(54) PARENT-CHILD DUAL RIDER SWING

(71) Applicant: BCI Burke Company, LLC, Fond du Lac, WI (US)

(72) Inventors: Bart Mayer, Fond du Lac, WI (US); Scott Liebelt, Oakfield, WI (US)

(73) Assignee: BCI Burke Company, LLC, Fond du Lac, WI (US)

( * ) Notice: Subject to any disclaimer, the term of this patent is extended or adjusted under 35 U.S.C. 154(b) by 0 days.

(21) Appl. No.: 16/127,485

(22) Filed: Sep. 11, 2018

(65) Prior Publication Data

US 2019/0076743 A1 Mar. 14, 2019

Related U.S. Application Data

(60) Provisional application No. 62/556,678, filed on Sep. 11, 2017.

(51) Int. Cl.

| | |
|---|---|
| ***A63G 9/02*** | (2006.01) |
| ***A63G 9/00*** | (2006.01) |
| ***A63G 9/12*** | (2006.01) |

(52) U.S. Cl.

CPC ..... *A63G 9/02* (2013.01); *A63G 9/00* (2013.01); *A63G 9/12* (2013.01)

(58) Field of Classification Search

CPC ..... A63G 9/02; A63G 9/12; A63G 9/00

See application file for complete search history.

(56) References Cited

U.S. PATENT DOCUMENTS

| | | | | |
|---|---|---|---|---|
| 4,256,300 | A | 3/1981 | Boucher | |
| 5,334,099 | A * | 8/1994 | Marra | A47D 13/105 472/118 |
| 6,767,059 | B1 * | 7/2004 | Rhoades | A47D 13/105 297/277 |
| 9,084,940 | B2 * | 7/2015 | Norquist | A63G 9/00 |
| 9,533,231 | B2 * | 1/2017 | Peres | A63G 9/00 |
| 2015/0057092 | A1 * | 2/2015 | Norquist | A63G 9/00 472/125 |
| 2015/0273347 | A1 | 10/2015 | Norquist et al. | |
| 2018/0200633 | A1 | 7/2018 | Norquist et al. | |
| 2018/0221776 | A1 * | 8/2018 | Keller | A63G 9/00 |

* cited by examiner

*Primary Examiner* — Michael D Dennis

(74) *Attorney, Agent, or Firm* — Boyle Fredrikson S.C.

(57) ABSTRACT

A playground swing that allows the caregiver to sit within a supportive swing seat while the small child sits on the caregiver's lap while facing the caregiver with their legs wrapped around the hips of the caregiver. The caregiver's legs are free to hand from the swing seat allowing them to pump their legs to provide a swinging motion to the swing while the child's back is supported by a backrest opposing the caregiver's seat allowing the caregiver's arms and hands to be free to interact.

17 Claims, 4 Drawing Sheets

PARENT-CHILD DUAL RIDER SWING

CROSS-REFERENCE TO RELATED APPLICATIONS

This application claims the benefit of U.S. Provisional Application No. 62/556,678, filed Sep. 11, 2017, and hereby incorporated by reference.

BACKGROUND OF THE INVENTION

The present invention relates to playground equipment, and in particular, to a playground swing allowing for a pair of riders to swing together while facing each other.

It has been increasingly desired to incorporate and enhance attunement play between individuals in playground equipment. Attunement play facilitates the nonverbal connection between people through play, such as between a caregiver and child. When the caregiver and child are aware and responsive to one another, the pair are engaged in a way in which verbal communication is not necessary and the right side of their brains, responsible for processing emotions and face recognition, are attuned. The nonverbal attunement is important for the child to feel loved and secure and associate the caregiver with dependability, affecting the child's relationships with caregivers and with others throughout life.

Not only does attunement play have the benefits of building and maintaining the emotional development of children but attunement play has the additional benefits of caregiver-child relationship bonding. In addition, less accidents and improved supervision may occur when the caregiver is engaged with the child during play.

Typical playground swings allow for swinging by a child while a caregiver pushes the child on the swing from behind the child. Although this type of playground swing allows the child and caregiver to interact, the child and caregiver are unable to interact nonverbally through eye contact, facial clues, or body language.

SUMMARY OF THE INVENTION

The present inventors have recognized that playground swings may be used to facilitate attunement play between children and caregivers, or between two individuals, by allowing the participants to interact nonverbally through eye contact, facial clues, body gestures, and physical touch. Not only does eye contact and facial clues allow the caregiver and child to be attuned to one another but the physical contact between the caregiver and child also allows the child to feel safe as the caregiver cradles and interacts with the child during play.

Accordingly, the present invention provides a playground swing that allows the caregiver to sit within a supportive swing seat while the small child sits on the caregiver's lap while facing the caregiver with their legs straddling the hips of the caregiver. The caregiver's legs are free to hang from the swing seat allowing them to pump their legs to provide a swinging motion to the swing while the child's back is supported by a backrest opposing the caregiver's seat allowing the caregiver's arms and hands to be free to interact.

In one embodiment, the present invention provides a swing having a rigid swing arm having an upper end attachable to a stationary support so that the swing arm may swing therebeneath; a seat pan attached to the lower end of the rigid swing arm having an upwardly exposed seat surface extending along a first horizontal plane to allow a first human to sit on the seat pan with their legs extending downward from the seat pan; a first upward extending seat back extending from a rear of the seat pan and having a first support surface adapted to support the first seated human user; and a second upward extending seat back extending along a front of the seat pan and having a second support surface adapted to support a second seated human user seated in the lap of the first seated human with their legs extending downward from the seat pan outside of the first upwardly extending seat back.

It is thus a feature of at least one embodiment of the invention to allow intimate contact between a caregiver and child during swinging and eliminate the need to lift the child into another seat where a two seated swing may become unstable or unbalanced.

The second seat back may be movable away from the front of the seat pan. A pole may extend from the seat pan along a vertical plane and permitting the second upward extending seat backs to slide upwardly and downwardly along the vertical plane. The pole may comprise of a pair of lateral poles.

It is thus a feature of at least one embodiment of the invention to provide ease of access to the seat pan and allow the seat pan to be used as a single person swing. The swing may include two poles to give the swing frame additional strength and give poles for the users' hands to grab onto.

A crossbar may extend above the seat pan along a horizontal plane and securing the second seat back in an upward position. The crossbar may be magnetic and provide a magnetic force between the crossbar and the at least one of the first and second upward extending seat backs to removably secure the at least one of the first and second upward extending seat backs to the crossbar.

It is thus a feature of at least one embodiment of the invention to allow the seat back to be moved out of the way during mounting but then quickly returned to its original position.

The rigid swing arm may include first and second rigid poles extending along lateral sides of the seat pan.

It is thus a feature of at least one embodiment of the invention to reduce twisting of the seat during swinging.

The first and second rigid poles may provide first ends connected to the first upwardly extending seat back and second ends connected to the seat pan.

It is thus a feature of at least one embodiment of the invention to provide a cage-like frame surrounding the users so that the child feels safe.

The first and second upward extending seat backs may be free from obstruction in a direction towards the other of the first and second upward extending seat backs.

It is thus a feature of at least one embodiment of the invention to allow the caregiver and child to freely interact within the swing's frame enclosure.

The second support surface may provide a substantially planar rear surface extending along a first vertical plane and having lateral side edges extending rearwardly along second and third vertical planes transverse to the first vertical plane and receiving a back of the second seated human user.

It is thus a feature of at least one embodiment of the invention to cradle with child within the second backrest.

The connection arms may contact a stop in a lower position. The second support surface of the second upward extending seat back may be raised above the seat pan in the lowered position.

It is thus a feature of at least one embodiment of the invention to allow the caregiver's legs to hang from the seat pan.

The first and second support surfaces may be less than 12 inches from a front or rear edge of the seat pan. The first and second support surfaces are less than 40 inches from each other.

It is thus a feature of at least one embodiment of the invention to provide a swing enclosure that allows the caregiver and child to share a single seat pan allowing for inherent balancing of the two person swing.

In another embodiment, the present invention provides a swing set assembly having a stationary support having outer support bars spaced horizontally and extending upwardly along a vertical plane from the ground and a crossbar extending across the outer support bars along a horizontal plane and elevated above the ground. The swing set also has a swing having a rigid swing arm having an upper end attachable to the crossbar so that the swing arm may swing there beneath; a seat pan attached to the lower end of the rigid swing arm having an upwardly exposed seat surface extending along a first horizontal plane to allow a first human to sit on the seat pan with their legs extending downward from the seat pan; a first upward extending seat back extending from a rear of the seat pan and having a first support surface adapted to support the first seated human user; and a second upward extending seat back extending along a front of the seat pan and having a second support surface adapted to support a second seated human user seated in the lap of the first seated human with their legs extending downward from the seat pan outside of the first upwardly extending seat back.

These particular objects and advantages may apply to only some embodiments falling within the claims and thus do not define the scope of the invention.

DETAILED DESCRIPTION OF THE INVENTION

Figure 1:
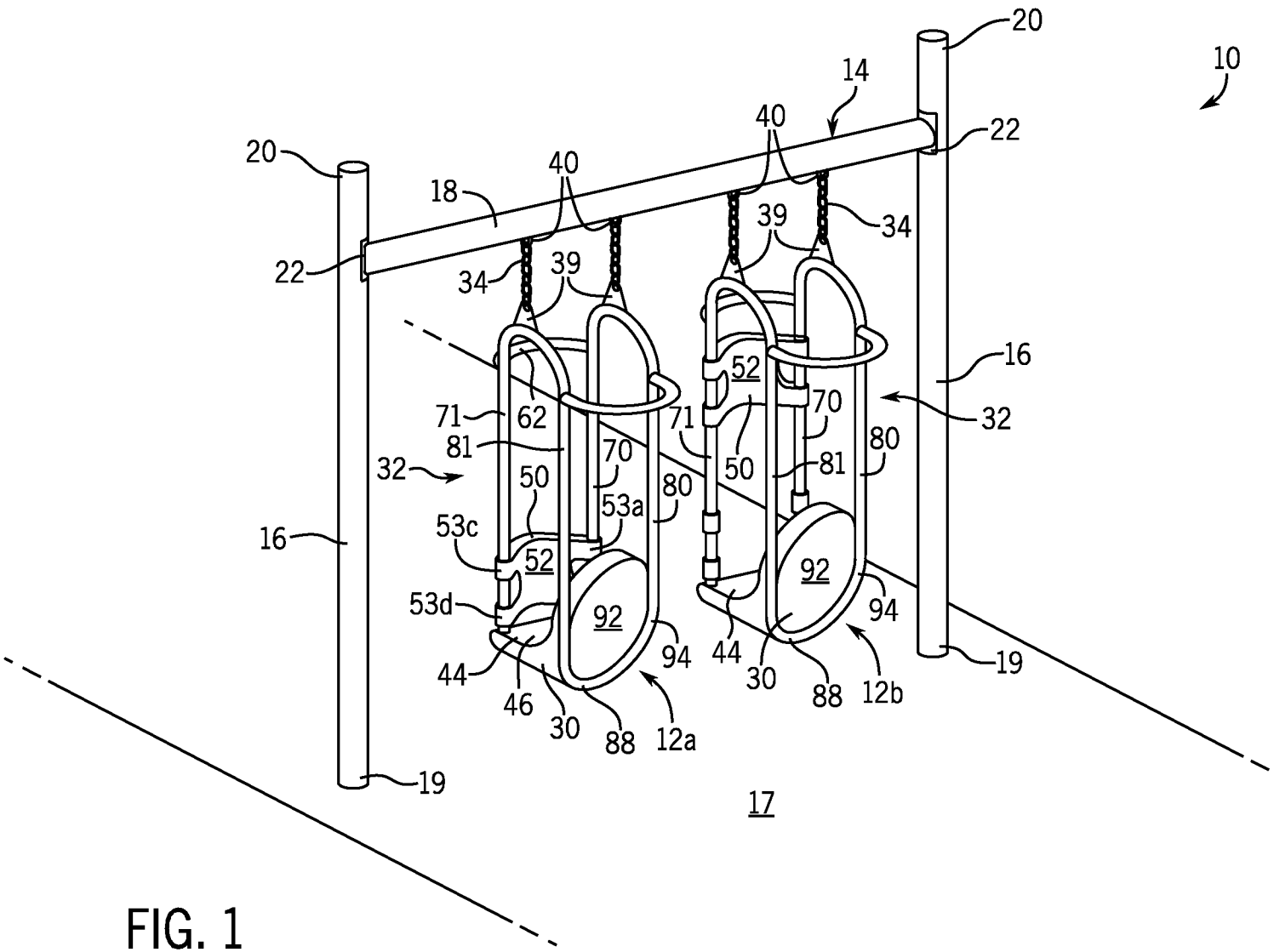
FIG. 1 is a perspective view of a single bay swing set with a pair of swings according to the present invention, showing a supportive caregiver seat positioned opposite a child back rest, the child back rest in a lowered position on the left side swing and the child back rest in a raised position on the right side swing, allowing the caregiver and child to swing together while facing one another.

Referring to FIG. 1, a swing set 10 having a stationary swing set frame 14 supporting a pair of swings 12 for pendular motion is provided.

The swing set frame 14 has a pair of vertically extending support poles 16 spaced horizontally and having a height of approximately 8 to 15 feet. The vertical support poles 16 may be anchored to the ground using ground anchors buried deep in the ground or concrete footings poured into the ground and supporting a bottom end 19 of each vertical pole 16

Upper ends of the vertical poles 16 are connected by a horizontal crossbar 18 supported therebetween for supporting the swings 12 hanging therebelow. The ends of the horizontal crossbar 18 may be mounted approximately 3 to 8 inches from a top end 20 of the vertical support poles 16. The horizontal crossbar 18 may be attached to the vertical support poles 16 by brackets or bolts 22 securing the horizontal crossbar 18 to the vertical support poles 16.

The horizontal crossbar 18 may be suspended at a height of about 8 to 15 feet above the ground corresponding generally to the height of the vertical support poles 16. Generally, a safety zone is required in front of and in back of the swings 12 that is double the height of the horizontal crossbar 18. For example, if the horizontal crossbar 18 is 10 feet above the ground, 20 feet is required in front of the swings 12 and behind the swings 12. Surfacing of the ground 17 below the swing set 10 and in the safety zone may include wood chips, rubber mulch, wood fiber, rubber tiles, and the like.

The support poles 16 are shown generally as single post vertical supports but may also be arch swing supports, two-way swing supports, or three-way swing supports as known in the art. For example, an arch swing frame may provide two vertically extending legs coupled at a top end by a curved or arched bar extending therebetween. A two-way swing support and three-way swing support provide two or three legs, respectively, connected at a top end, for example by a bracket, and angled downwardly and outwardly from the top end. Additional horizontal bars may extend between the legs of the two-way swing support and three-way swing support for additional support. It is understood that the support poles 16 may be substantially vertical or be angled depending on the style of swing set frame 14 and as desired to provide additional space underneath the swing set frame 14.

The swing set frame 14 may be constructed of rigid material such as metal, for example, galvanized steel, or a wood material, for example, cedar redwood or pine. The swing set frame 14 may further be powder coated to be durable against rusting.

Although the swing set 10 is shown in FIG. 1 as a single bay, it is understood that the swing set 10 may incorporate multiple bays or sections of swing set 10 between support poles 16. Additionally, while a pair of swings 12 is shown, any number of swings 12 may be installed within each bay such as one, two, three, four, or more.

The swing set frame 14 may be similar to commercial swing frames such as sold by the present applicant, BCI Burke Company LLC of Fond du Lac, Wis.

Figure 2:
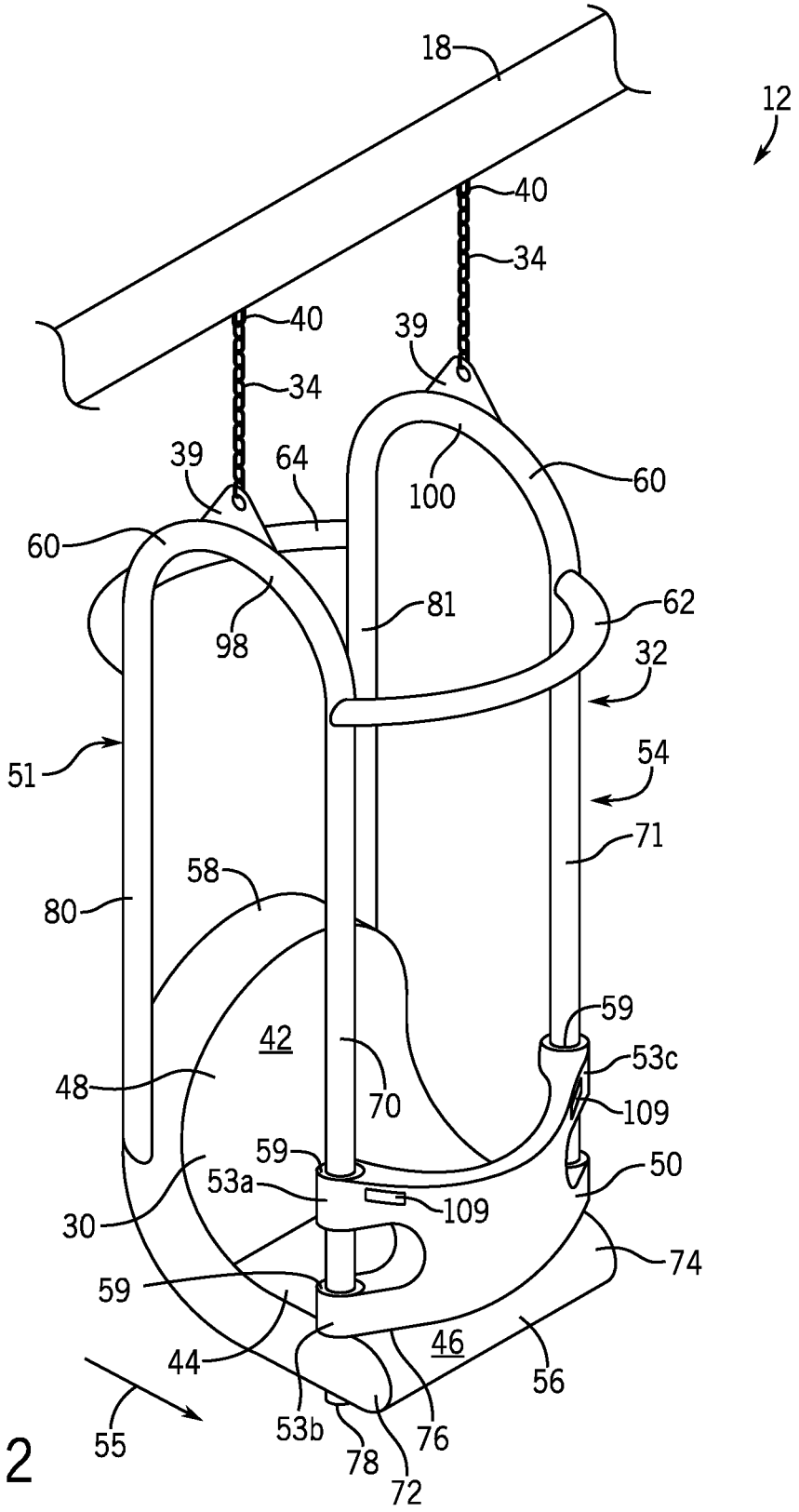
FIG. 2 is a perspective view of the swing of the present invention with the child back rest in the lowered position.

Referring now to FIGS. 1 and 2, the swings 12 of the swing set 10 may be attached to and suspended below the horizontal crossbar 18 and spaced apart from one another, for example, at least 12 inches, along the horizontal crossbar 18 to prevent the swings 12 from interfering with one another. Each swing 12 may include a seat frame 32 attached to the horizontal crossbar 18 of the swing set frame 14 by a pair of coupling linkages 34 and supporting a caregiver support seat 30 and child back rest 50.

Figure 3:
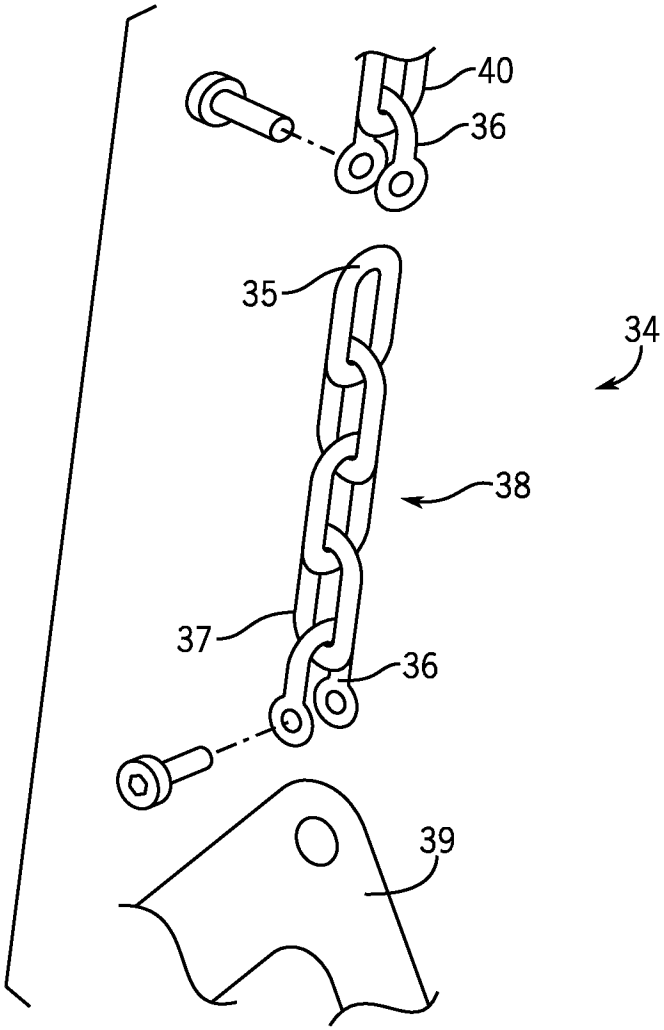
FIG. 3 is an enlarged view of a coupling linkage providing height adjustable attachment of the swing of the present invention to a swing frame.

Referring to FIG. 3, the coupling linkages 34 of the swing set 10 may comprise of upper and lower fasteners 36, the upper fastener 36 connecting the horizontal crossbar 18 to a first end 35 of a chain-link 38, and the lower fastener 36 connecting a second end 37 of the chain-link 38 to the seat frame 32. In this respect, the horizontal crossbar 18 and seat frame 32 may include anchor bolts and/or eye bolts 40 or mounting plates 39 with holes, respectively, that allow the fasteners 36 and chain-link 38 to be attached thereto.

The fasteners 36 may allow for the height adjustable connection of the seat frame 32 to the horizontal crossbar 18 by adjusting a length of the chain-link 38 between the fasteners 36. In one example, the fasteners 36 may be Clevis type fasteners having a U-shaped piece with opposed holes receiving a pin and held in place by a split pin. In this respect, the user may fasten or unfasten the fasteners 36 as desired to adjust the chain-link 38 to a desired length.

The coupling linkages 34 allows a height of the seat frame 32 and caregiver support seat 30 to be adjustable above the ground 17. In one example, the coupling linkages 34 may be adjusted such that a bottom surface of the caregiver support seat 30 is positioned approximately 12 to 20 inches above the ground 17 to allow a seated adult user's legs to hang from and below the caregiver support seat 30. The pair of coupling linkages 34 of each swing 12 may be adjusted to a substantially same length so that opposite sides of the swing 12 are at a substantially same height above the ground 17.

The fasteners 36 may also allow for the seat frame 32 to be removed from the horizontal crossbar 18 as desired or for the swings 12 to be easily interchanged or replaced.

It is understood that other types of coupling linkages 34 and fasteners 36 may be used in a similar manner as described above to attach the swing set frame 14 to the horizontal crossbar 18. It is also understood that the coupling linkages 34 may also be pivot joints or other types of pivots without the use of chain-links 38.

Referring to FIGS. 1 and 2, the seat frame 32 may present left and right inverted U-shaped frames 51, 54 suspended by the coupling linkage 34 at an upper end of the inverted U-shaped arches for example by an upwardly extending mounting plate 39 having a hole opening. The U-shaped frames 51, 54 are spaced horizontally and extend generally along vertical planes along left and right sides of the seat frame 32, respectively.

An upper end of the U-shaped frames 51, 54 may be defined by arched rods 98, 100 extending downwardly to lower front and rear ends. Front ends of the arched rods 98, 100 may include downwardly extending forward vertically extending poles 70, 71 and a rear end of the arched rods 98, 100 may include downwardly extending rearward vertically extending poles 80, 81.

Upper ends 60 of the left and right U-shaped frames 51, 54 are attached by front and rear crossbars 62, 64 extending generally along a horizontal plane. The front crossbar 62 may extend from the forward vertically extending poles 70, 71 generally along a horizontal plane and bow outward in a forward direction 55. In a similar, mirrored manner, the rear crossbars 64 may extend generally along a horizontal plane and bow outward in a rearward direction, opposite the forward direction 55.

Referring now to FIGS. 1 and 2, the caregiver support seat 30 may comprise of a seat pan 44 presenting an upper surface 46 extending generally along a horizontal plane and on which an average adult user may sit. The upper surface 46 may be a generally planar surface or be a generally upwardly concave curved surface conforming or contoured to the curves of a buttocks of the user.

A seat back 48 may extend upward generally along a vertical plane from a rear of the seat pan 44 to present a support surface 42 supporting a back of the average adult user thereagainst when seated. The support surface 42 may be a generally planar surface or a forwardly concave curved surface conforming or contoured to the curves of a back of the adult user. In one embodiment, the seat back may be integrally molded out of plastic with the seat pan.

It is understood that the dimensions of the seat pan 44 and seat back 48 may accommodate the dimensions of an average adult user to provide a comfortably sized seat. For example, the seat pan 44 may have dimensions of 25 to 27 inches back to front and 25 to 26 inches side to side. The seat back 48 may have dimensions of 14 to 16 inches top to bottom and 25 to 26 inches side to side. It is also understood that an angle between the seat pan 44 and seat back 48 may be inclined to provide comfort by angling the seat back 48 approximately 20 to 30° or approximately 25° rearward with respect to vertical.

Although the caregiver support seat 30 is described with respect to supporting an average adult user, it is also understood that the caregiver support seat 30 may also support an adolescent or a child who may be swinging with a second child as further described below. In this respect, the caregiver support seat 30 may support the size of a smaller individual who is smaller than an average adult user and may be the size of an average adolescent or child such that the swing is used by an adolescent and a child or two children of about the same size.

A front end 56 of the seat pan 44 may be supported by the forward vertically extending poles 70, 71 of the seat frame 32. The forward vertically extending poles 70, 71 may be attached rearward from the front 56 of the seat pan 44 approximately 1 to 2 inches and proximate the lateral side edges 72, 74 of the seat pan 44. The forward vertically extending poles 70, 71 may extend through holes 76 of the seat pan 44 and then secured by end caps 78 attached to bottom ends of the forward vertically extending poles 70, 71 below the seat pan 44 and having an outer dimension that is greater than an outer dimension of the holes 76 of the seat pan 44, preventing the end caps 78 from sliding through the holes 76. The approximately 1 to 2 inches and proximate the lateral side edges 72, 74 of the seat pan 44. The forward vertically extending poles 70, 71 may also be attached to the seat pan 44 using an adhesive.

A rear 58 of the seat back 48 may be supported by the rearward vertically extending poles 80, 81 of the seat frame 32. The rearward vertically extending poles 80, 81 may be attached to the seat back 48 by a sling frame 88 defined by a U-shaped tube attaching the bottom ends of the rearward vertically extending poles 80, 81 together and extending therebetween across a back surface 92 of the seat back 48 opposite the support surface 42. The back surface 92 of the seat back 48 may include a corresponding groove 94 permitting the sling frame 88 to be positioned within the groove 94 of the back surface 92 for a more even surface.

The forward vertically extending poles 70, 71 of the seat frame 32 may further support a child back rest 50 located in front of the seat back 48 of the caregiver support seat 30 and extending upward generally along a vertical plane to present a rearward facing support surface 52. The support surface 52 supports a back of an average child user when the child user is seated on the average adult user's lap in a face-to-face lap hold whereby the child user's legs are wrapped around or straddle the adult user's hips.

The support surface 52 may be a generally planar back surface extending along a substantially vertical plane, or forwardly angled vertical plane as discussed below, and having lateral outwardly and rearwardly curved sides extending along transverse vertical planes and terminating approximately 3 to 4 inches rearwardly from the back surface. The support surface may also be a rearwardly concave curved surface conforming or contoured to the curves of the back of the child user.

A top edge of the support surface 52 may be angled forward 55, for example between 20 to 30° or approximately 22° with respect vertical, so that the support surface 52 is inclined to allow the seated child user to recline slightly away from the caregiver support seat 30 to a comfortable seated position and to provide additional space between the seated adult user and child.

The support surface 52 of the child back rest 50 may be attached to the seat frame 32 by lateral connection arms 53 being generally cylindrical in shape and extending laterally outwardly and rearwardly from the side edges of the support surface 52. An upper left arm 53*a* extends from an upper left edge of the support surface 52, a lower left arm 53*b* extends from a lower left edge of the support surface 52, an upper right arm 53*c* extends from an upper right edge of the support surface 52, and a lower right arm 53*d* extends from a lower right edge of the support surface 52. The connection arms 53 may be curved so that the arms 53 bow outward toward the caregiver support seat 30.

Each of the connection arms 53 may include passages 59 extending generally along vertical axes to receive the forward vertically extending poles 70, 71 of the seat frame 32. The child back rest 50 may be slid upward and downward as indicated by arrow 57 along vertically extending poles of the seat frame 32.

Figure 4:
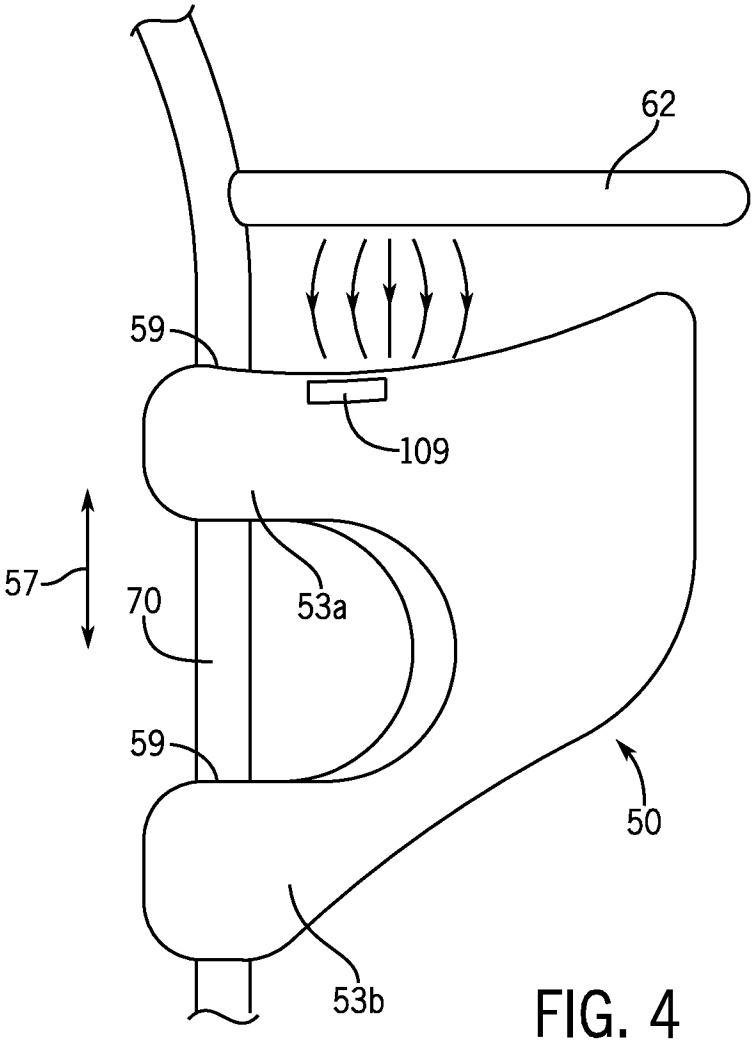
FIG. 4 is a side perspective view of the swing where the child back rest is in the raised position and having a magnetic lock engaging an upper frame to maintain the child back rest in the raised position.
Figure 5:
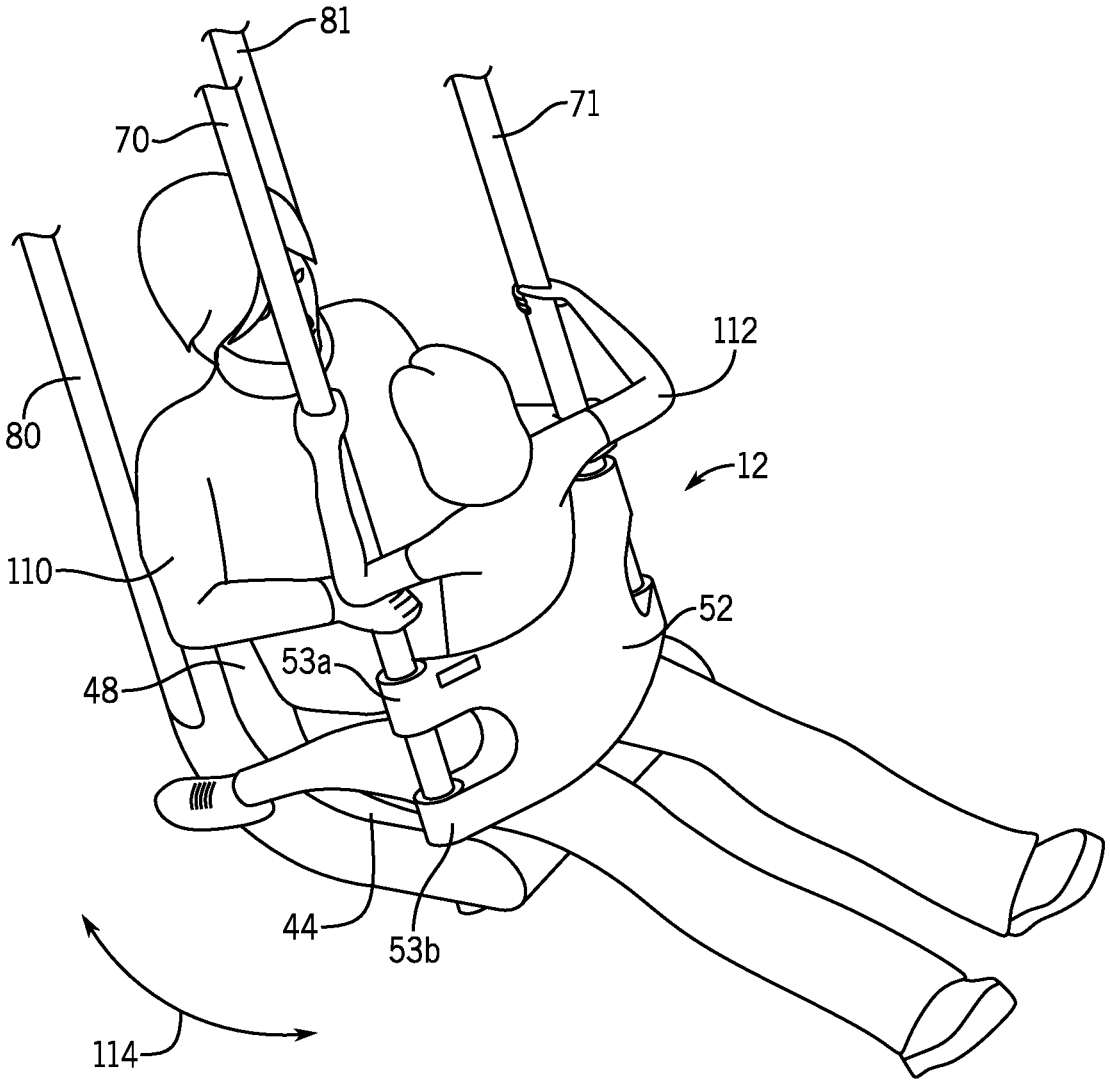
FIG. 5 is a perspective view of a caregiver seated in the supportive caregiver seat and a child seated on the caregiver's lap facing the caregiver according to the present invention.

As best seen in FIGS. 4 and 5, the lower connection arms 53*b*, 53*d* may be angled downward from the support surface 52 of the child back rest 50 to the seat frame 32 so that the support surface 52 is raised above the seat pan 44 when the lower connection arms 53*b*, 53*d* contact the seat pan 44. The space created between the support surface 52 and the seat pan 44 allow the legs of the seated adult user to extend below the support surface 52 of the child back rest 50 when the child back rest 50 is in the lowered position and to hang from the seat pan 44. The lowered position is defined by the lower connection arms 53*b*, 53*d* of the child back rest 50 contacting the seat pan 44.

Referring to FIG. 4, a top edge of the child back rest 50 may include magnets 109 producing a magnetic field with a metal of the front crossbar 62. In this respect, the child back rest 50 may be slid upward along the forward vertically extending poles 70, 71 so that the child back rest 50 is magnetically secured to the front crossbar 62 thereabove and the adult user may mount the caregiver support seat 30 seat while the child back rest 50 is raised above the caregiver support seat 30 without it sliding downward. The child back rest 50 and front crossbar 62 may have an approximately similar curvature.

The front and rear crossbars 62, 64 may be positioned approximately 40 to 50 inches above the seat pan 44 of the caregiver support seat 30. This height allows the adult user to raise the child back rest 52 to a raised position so that it is magnetically secured to the front crossbar 62 but also allows the adult user to reach the child back rest 50 when seated and pull the child back rest 50 downward to the lowered position so that it may support the back of the child user when seated. The raised position is defined by the support surface 52 of the child back rest 50 contacting the front crossbar 62 of the seat frame 32.

It is understood that the magnetic attraction between the child back rest 52 and the front crossbar 62 is strong enough to maintain the child back rest 50 in the raised position but allows the adult user to manually pull the child back rest 50 downward to the lowered position without external force. For example, the force of the magnets may be 5 lbs. or less.

The child back rest 52 may also be raised and secured to the front crossbar 62 by other securing means such as Velcro or latches. Instead of the child back rest 52 being raised out of the way, it is possible that the child back rest 52 may be a hinged swing door that is swung out of the way.

The caregiver support seat 30 and the child back rest 50 may be made of a blow, injection, or rotational molded plastic, and may be ultraviolet (UV) stabilized to be resistant against fading and degradation.

The seat frame 32 may be constructed of metal such as galvanized steel. It is understood that the front crossbar 62 is contemplated to be a magnetic metal material but it is also understood that the front crossbar 62 may be a nonmagnetic material but may instead include a separately attached magnet to magnetically attract the corresponding magnets 109 of the child back rest 50. In such an embodiment, it is understood that the magnets are aligned to encourage a magnetic field.

In one embodiment, a bottom edge of the child back rest 50 may also include magnets attracted to corresponding magnets of the seat pan 44 of the caregiver support seat 30 such that the child back rest 50 is magnetically secured to the seat pan 44 when in the lowered position, in addition to the raised position. It is also understood that this may be optional since the weight of the child back rest 50 alone may be enough force to maintain the child back rest 50 in the lowered position.

Referring to FIG. 5, the swing 12 of the present invention may be used by an adult user 110, and typically a larger of the two participants, such that the adult user 110 supports the child user 112 on their lap. It is understood that the adult user 110 may also be a larger child or adolescent who is able to support the smaller child on their lap. It is also contemplated that the swing 12 may be used by two children of similar size in a similar manner as taught.

The adult user 110 may mount the swing 12 by raising the child back rest 50 upward along the forward vertically extending poles 70, 71 to a height such that an attractive magnetic force between the child back rest 50 and the front crossbar 62 pulls the child back rest 50 to the raised position allowing the adult user 110 to seat themselves within the caregiver support seat 30 (see swing 12*b* in FIG. 1 in the raised position).

Once the adult user 110 is seated within the caregiver support seat 30 the adult user 110 reaches upward with their arms to pull down and lower the child back rest 50 along direction arrow 57 and along the forward vertically extending poles 70, 71 such that the child back rest 50 contacts the seat pan 44 of the caregiver support seat 30 in the lowered position (see also swing 12*a* in FIG. 1 in the lowered position). It is understood that if the adult user 110 is unable to reach the child back rest 50 from the raised position another individual may assist the adult user 110 in lowering the child back rest 50.

The adult user 110 may carry the child user 112 while mounting the caregiver support seat 30 or after mounting the caregiver support seat 30 the child user 112 may be lifted onto the lap of the adult user 110 such that the legs of the child user 112 straddle or wrap themselves around the hips of the adult user 110. The child user 112 is positioned to face the adult user so that the adult user 110 and child user 112 may maintain eye contact and observe each other's facial expressions and body language. It is understood that the child user 112 can also be positioned facing away from the adult user so that the child user 112 and adult user 110 face the same direction when swinging. Another individual may assist the adult user 110 in positioning the child user 112 on the swing 12.

During play, the adult user 110 and child user 112 may hold onto the forward vertically extending poles 70, 71 for stabilization while the adult user 110 pumps their legs to swing the swing 12 back and forth in a swinging motion as indicated by arrow 114. The arms and hands of the adult user 110 and child user 112 may also be free to interact with one another, for example, allowing the adult user 110 to cradle the child user 112. In this respect the swing 12 allows for physical touch between the adult user 110 and child user 112 by allowing for hands-free interaction between the adult user 110 and child user 112 during swinging and facilitated by the enclosure created by the child back rest 50.

The cage-like enclosure created by the seat back 48 of the caregiver support seat 30 and the child back rest 50 provides for a space therebetween wherein there is unobstructed space therebetween, forward of the seat back 48 and rearward of the child back rest 50 allowing the adult user 110 and child user 112 to interact in that space. The distance between the closest point between the support surface 42 of the seat back 48 of the caregiver support seat 30 and support surface 52 of the child back rest 50 may be at least 40 to 50 inches. A farthest point of the support surface 52 of the child back rest 50 may be less than 12 inches from the front 56 of the seat pan 44.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What we claim is:

1. A swing for promoting physical contact and attunement between a caretaker and a child, the swing comprising:

a swing arm having an upper end attachable to a stationary support so that the swing arm may swing there beneath;

a seat pan attached to a lower end of the swing arm having an upwardly exposed seat surface extending along a first horizontal plane to allow a first human user to sit on the seat pan with their legs extending downward from the seat pan;

a first seat back attached to and extending upwardly from a rear of the seat pan and having a first support surface adapted to support a back of the first seated human user;

a second seat back extending upwardly along a front of the seat pan, above a level of the seat pan, and moveable vertically away from the seat pan and having a second support surface adapted to support a back of a second seated human user seated in a lap of the first seated human user and facing the first seated human user with their legs extending downward from the seat pan outside of the first seat back in an opposite direction as the legs of the first seated human user; and a rigid support restraining the second seat back with respect to movement away from the first seat back.

2. The swing of claim 1 wherein the second seat back is slidable along the rigid support away from the seat pan.

3. The swing of claim 2 wherein the rigid support is a pole extending from the seat pan along a vertical plane at the front of the seat pan and permitting the second seat back to slide upwardly and downwardly along the vertical plane.

4. The swing of claim 3 wherein the pole comprises a pair of lateral poles.

5. The swing of claim 1 wherein the swing arm comprises first and second rigid poles extending along lateral sides of the seat pan.

6. The swing of claim 5 wherein the first and second rigid poles provide first ends connected to the first seat back and second ends connected to the seat pan.

7. The swing of claim 1 wherein the first and second upward extending seat backs are free from obstruction in a direction towards the other of the first and second upward extending seat backs.

8. The swing of claim 1 wherein the second support surface provide a substantially planar rear surface extending along a first vertical plane and having lateral side edges extending rearwardly along second and third vertical planes transverse to the first vertical plane and receiving a back of the second seated human user.

9. The swing of claim 1 wherein the first and second support surfaces are less than 12 inches from a front or rear edge of the seat pan.

10. The swing of claim 9 wherein the first and second support surfaces are less than 40 inches from each other.

11. A swing for promoting physical contact and attunement between a caretaker and a child, the swing comprising:

a swing arm having an upper end attachable to a stationary support so that the swing arm may swing there beneath;

a seat pan attached to a lower end of the swing arm having an upwardly exposed seat surface extending along a first horizontal plane to allow a first human user to sit on the seat pan with their legs extending downward from the seat pan;

a first upward extending seat back extending from a rear of the seat pan and having a first support surface adapted to support the first seated human user;

a second upward extending seat back extending along a front of the seat pan and having a second support surface adapted to support a second seated human user seated in a lap of the first seated human user with their legs extending downward from the seat pan outside of the first upwardly extending seat back; and a crossbar extending above the seat pan along a horizontal plane and securing the second seat back in an upward position;

wherein the second seat back is movable away from a front of the seat pan.

12. The swing of claim 11 wherein the crossbar is magnetic and provides a magnetic force between the crossbar and the at least one of the first and second seat backs to removably secure the at least one of the first and second seat backs to the crossbar.

13. A swing for promoting physical contact and attunement between a caretaker and a child, the swing comprising:

a swing arm having an upper end attachable to a stationary support so that the swing arm may swing there beneath;

a seat pan attached to a lower end of the swing arm having an upwardly exposed seat surface extending along a first horizontal plane to allow a first human user to sit on the seat pan with their legs extending downward from the seat pan;

a first upward extending seat back extending from a rear of the seat pan and having a first support surface adapted to support the first seated human user; and a second upward extending seat back extending along a front of the seat pan and having a second support surface adapted to support a second seated human user seated in a lap of the first seated human user with their legs extending downward from the seat pan outside of the first upwardly extending seat back wherein the second support surface provide a substantially planar rear surface extending along a first vertical plane and having lateral side edges extending rearwardly along second and third vertical planes transverse to the first vertical plane and receiving a back of the second seated human user wherein the second upward extending seat back further comprises connection arms extending from the second support surface toward the first upward extending seat back and connecting the second upward extending seat back to the swing arm.

14. The swing of claim 13 wherein the connection arms contact a stop in a lowered position.

15. The swing of claim 14 wherein the second support surface of the second upward extending seat back is raised above the seat pan in the lowered position.

16. A swing set assembly for promoting physical contact and attunement between a caretaker and a child, the swing set assembly comprising:

a stationary support having outer support bars spaced apart and extending upwardly along a vertical plane from a ground; and a crossbar extending across the outer support bars along a horizontal plane and elevated above the ground;

a swing having a swing arm having an upper end attachable to the crossbar so that the swing arm may swing there beneath;

a seat pan attached to a lower end of the swing arm having an upwardly exposed seat surface extending along a first horizontal plane to allow a first human user to sit on the seat pan with their legs extending downward from the seat pan;

a first seat back attached to and extending upwardly from a rear of the seat pan and having a first support surface adapted to support a back of the first seated human user; and a second seat back extending upwardly along a front of the seat pan, above a level of the seat pan, and moveable vertically away from the seat pan and having a second support surface adapted to support a back of a second seated human user seated in a lap of the first seated human user facing the first seated human user with their legs extending downward from the seat pan outside of the first seat back and in an opposite direction as the legs of the first seated human user; and a rigid support restraining the second seat back with respect to movement away from the first seat back.

17. A swing for promoting physical contact and attunement between a caretaker and a child, the swing comprising:

a seat pan suspended above a ground by a stationary support and having an upwardly exposed seat surface extending along a first horizontal plane to allow a first human user to sit on the seat pan with their legs extending downward from the seat pan;

a first upward extending seat back extending from a rear of the seat pan and having a first support surface adapted to support the first seated human user; and a second upward extending seat back extending along a front of the seat pan and having a second support surface adapted to, in a lowered position, support a second seated human user seated in a lap of the first seated human user with their legs extending downward from the seat pan outside of the first upwardly extending seat back;

wherein the second upward extending seat back is magnetic and is removably held in a raised position above the first upward extending seat back by a magnetic force.

* * * * *